United States Patent [19]

Foster et al.

[11] Patent Number: 4,602,248

[45] Date of Patent: Jul. 22, 1986

[54] ELECTRICAL ATMOSPHERIC PRESSURE ALARM

[76] Inventors: Michael L. Foster; Harold L. Foster, both of 514 W. Nodaway; Michael A. Powers, 312 E. Chestnut St., all of Clarinda, Iowa 51632

[21] Appl. No.: 710,459

[22] Filed: Mar. 11, 1985

[51] Int. Cl.[4] ..... G08B 21/00

[52] U.S. Cl. ..... 340/601; 73/170 R; 73/384; 340/626

[58] Field of Search ..... 340/601, 611, 614, 626; 73/170 R, 189, 384, 386; 200/83 A, 83 C, 83 D

[56] References Cited

U.S. PATENT DOCUMENTS

| | | | |
|---|---|---|---|
| 86,114 | 2/1914 | Yaggy | 73/384 X |
| 2,976,522 | 3/1961 | Dowling | 340/601 X |
| 3,029,422 | 4/1962 | Wilson | 340/601 |
| 3,266,315 | 8/1966 | Shively | 116/101 X |
| 3,315,462 | 4/1967 | Bosquet | 340/601 X |
| 3,336,798 | 8/1967 | Twohey | 73/384 X |
| 3,623,051 | 11/1971 | Juno | 73/386 X |
| 3,631,435 | 12/1971 | Elenbaas | 340/601 X |
| 3,646,540 | 2/1972 | Cooper | 340/601 X |
| 3,748,656 | 7/1973 | Gray et al. | 340/626 X |
| 3,810,137 | 5/1974 | Bacon, Jr. et al. | 340/601 X |
| 3,914,755 | 10/1975 | Hook | 340/626 X |
| 4,279,028 | 7/1981 | Lowdenslager et al. | 73/170 X |

*Primary Examiner*—James L. Rowland
*Assistant Examiner*—Daniel Myer
*Attorney, Agent, or Firm*—Zarley, McKee, Thomte, Voorhees

[57] ABSTRACT

The atmospheric pressure actuated alarm of the present invention comprises a pressure transducer which senses the atmospheric pressure and produces an electrical transducer signal in response thereto. A difference amplifier is connected to the pressure transducer for measuring the transducer signal and for producing an output signal whenever the transducer signal is of a magnitude outside a predetermined range. An operational amplifier is connected to the difference amplifier for amplifying the transducer signal. A latch is connected to the operational amplifier for receiving the amplified signal. A signal alarm and a power source are connected in series with the latch. The latch is changeable from an open condition to a closed condition in response to the amplified signal being greater than a predetermined magnitude. When the latch moves to the closed condition, it connects the power source to the alarm signal and causes actuation of the alarm signal.

5 Claims, 1 Drawing Figure

ELECTRICAL ATMOSPHERIC PRESSURE ALARM

BACKGROUND OF THE INVENTION

This invention relates to an electrical atmospheric pressure alarm.

Various devices have been provided for attempting to warn persons of an approaching tornado. Some of these alarms are triggered by the drastic drop in atmospheric pressure immediately prior to the approach of a tornado. However, these devices are often unreliable, sometimes causing an alarm when a tornado is not approaching, and other times malfunctioning when a tornado does in fact approach.

Many of these tornado alarms operate off of mechanical means which respond to the atmospheric pressure. These mechanical means are often unreliable, particularly in view of the fact that the tornado alarm may lie at rest without functioning for long periods of time. Rust and corrosion can cause the alarm to malfunction or not to function properly.

There are other applications for a reliable atmospheric pressure alarm. For example, aircraft and submarines need devices for sensing changes in atmospheric pressure.

Therefore, a primary object of the present invention is the provision of an improved tornado alarm.

A further object of the present invention is the provision of an alarm which is more reliable than prior devices.

A further object of the present invention is the provision of an improved atmospheric pressure alarm which is entirely electrical in operation and which does not rely upon mechanical parts for proper functioning.

A further object of the present invention is the provision of a device which is economical to manufacture, durable in use and efficient and reliable in operation.

SUMMARY OF THE INVENTION

The present invention comprises a pressure transducer which is adapted to sense changes in the atmospheric pressure and to produce an electrical transducer signal in response to changes in atmospheric pressure. A difference amplifier is connected to the pressure transducer and measures the transducer signal against a reference signal within the difference amplifier. If the transducer signal exceeds a predetermined range, the difference amplifier produces an output signal which is sent on to an operational amplifier.

The operational amplifier receives the signal from the difference amplifier and amplifies it. The signal is then sent on to a DC latch circuit.

The latch circuit functions as an electrical switch. It is connected in series with a signal alarm and a power source. In its normal condition, the latch maintains an open circuit between the power source and the signal alarm so that the signal alarm will not be actuated.

However, when the latch circuit receives a signal from the operational amplifier which is above a predetermined level, the latch circuit changes from an open condition to a closed condition so as to close the circuit between the power source and the signal alarm. This causes actuation of the signal alarm.

The signal alarm may be an audio alarm such as a buzzer or it may be a visual alarm such as a light. Other types of alarms could also be used. Furthermore, it is possible to use one or more different types of alarms to be actuated simultaneously in response to the closing of the latch circuit.

DETAILED DESCRIPTION OF THE PREFERRED EMBODIMENT

Figure 1:
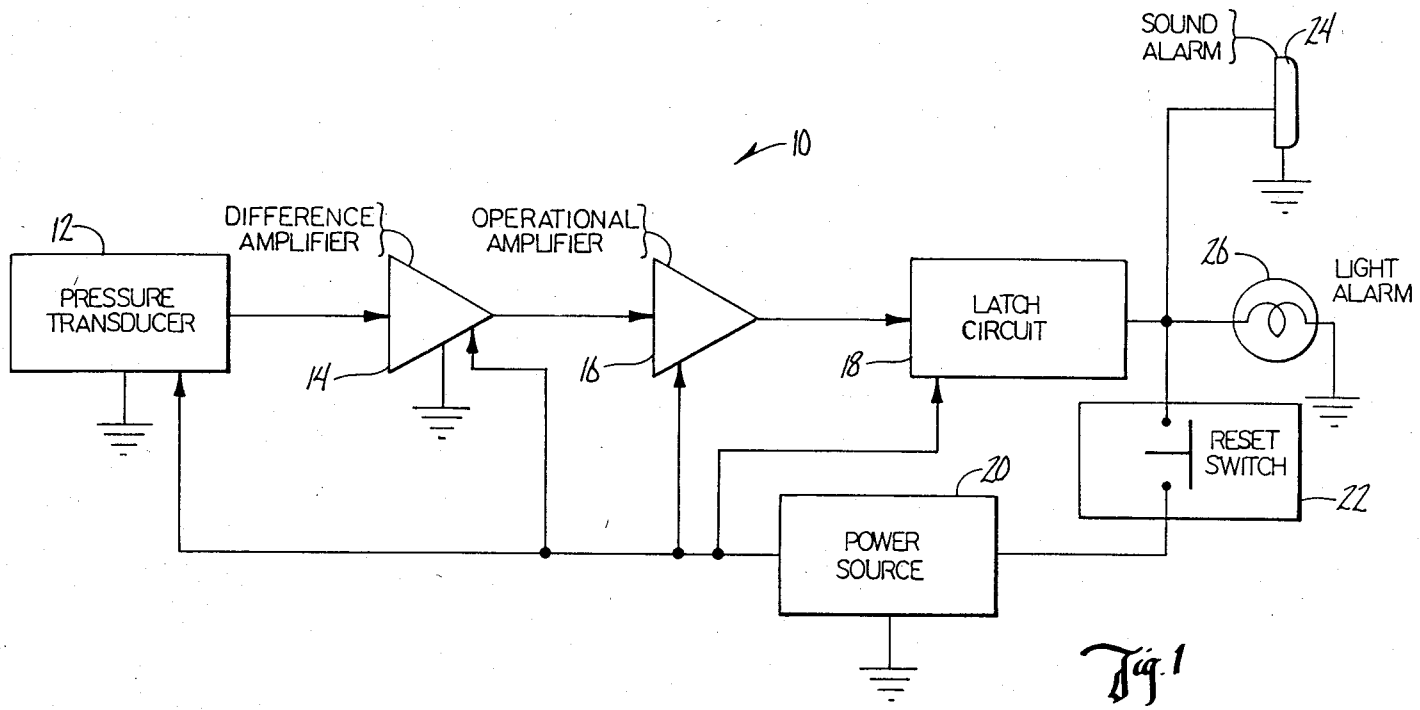
FIG. 1 is a block diagram of the circuit of the alarm of the present invention.

Referring to the drawings, the numeral 10 generally designates the tornado alarm circuit of the present invention. Circuit 10 includes a pressure transducer 12, a difference amplifier 14, an operational amplifier 16, a latch circuit 18, a power source 20, a reset switch 22, a sound alarm 24, and a light alarm 26. Pressure transducer 12 is adapted to sense changes in atmospheric pressure and to produce an output transducer signal in response thereto. An example of a pressure transducer which will work with the present invention is a transducer Model No. 442-699, available from Heath Company, whose address is Benton Harbor, Mich. 49022.

Difference amplifier 14 is adapted to receive the transducer signal and to measure it against a reference signal which is provided in the internal circuitry of difference amplifier 14. If the transducer signal differs from the reference signal by a predetermined magnitude, it will cause the difference amplifier to produce an output signal which is sent to the operational amplifier 16. An example of a difference amplifier which will work in the present circuit is an amplifier designated by Model No. SK-3643, manufactured by RCA Corporation, having an address of 2000 Clements Bridge Road, Deptford, N.J. 08096.

The operational amplifier 16 receives the output signal from the difference amplifier, and amplifies this signal sending it on to the latch circuit. An example of an operational amplifier which will work in the present circuit is amplifier designated by Model No. SK-3643, manufactured by RCA Corporation, having an address of 2000 Clements Bridge Road, Deptford, N.J. 08096.

Latch circuit 18 receives the amplified signal from the operational amplifier 16. Latch circuit 18 functions as an electrical switch which is normally open, but which will close in response to receiving a signal from the operational amplifier which exceeds a predetermined amplitude. An example of such a latch circuit is a circuit Model No. 276-1067, available from Tandy Corporation, having an address of Ft. Worth, Tex. 76102.

Latch circuit 18 is connected in series with the power source 20, the reset switch 22 and the sound and light alarm 24, 26. In its normal condition, latch circuit 18 is open, thereby preventing actuation of the sound alarm or the light alarm. However, when the latch circuit receives a signal from the operational amplifier which matches or exceeds a predetermined amplitude, the latch circuit changes conditions to a closed condition so that it closes the circuit between the power source and the alarms 24, 26. This causes the alarms to be actuated.

The alarms may be reset by the reset switch which deactuates them and places the latch circuit back in its natural open position.

The various threshholds for difference amplifier 14 and for latch circuit 18 are chosen so that the alarms will only be actuated when the atmospheric pressure drops below a predetermined value, or increases above a predetermined value. The particular predetermined values can be chosen so as to insure that the alarms will only be actuated upon the approach of a tornado.

The power source 20 can be a DC power source, such as a battery, or it can be connected to an alternating current source by means of a transformer. The power source is shown in the drawing to provide a source of electrical power to the pressure transducer, the difference amplifier, the operational amplifier and the latch circuit. However, it is possible to use different power sources for each of these components if desired.

The present invention provides a solid state circuit which is far more reliable than presently known mechanical circuits for detecting pressure drops from tornados. The circuit does not include any moving parts, and therefore is far less susceptible to damage from corrosion or from other types of damage occurring during inactivity.

Thus, it can be seen that the device accomplishes at least all of its stated objectives.

What is claimed is:

1. An atmospheric pressure actuated alarm comprising:

a pressure transducer adapted to sense changes in atmospheric pressure and to produce an electrical transducer signal in response thereto;

a difference amplifier connected to said pressure transducer for measuring said transducer signal and being adapted to produce an output signal whenever said transducer signal is of a predetermined magnitude resulting from exposure of said transducer to the atmospheric pressure change caused by a tornado;

an operational amplifier connected to said difference amplifier for producing an amplified signal corresponding to said output signal received from said difference amplifier;

latch means connected to said operational amplifier for receiving said amplified signal;

signal means connected to said latch means and being capable of actuation to cause a humanly perceptible warning signal; p1 a power source connected in series with said latch means and said signal means;

said latch means being changeable from an open condition to a closed condition in response to said amplified signal being greater than a predetermined magnitude whereby said power source will be placed in electrical connection with said signal means to cause actuation of said signal means;

said pressure transducer, said difference amplifier, said operational amplifier, and said latch means comprising solid state circuitry and being free from moving parts.

2. An alarm according to claim 1 wherein a reset switch is connected between said power source and said signal means for permitting the selective manual deactuation of said signal means.

3. An alarm according to claim 2 wherein said signal means comprises a sound alarm means.

4. An alarm according to claim 2 wherein said signal means comprises a warning light means.

5. An alarm according to claim 2 wherein said signal means comprises both a warning light means and a sound alarm means.

* * * * *